United States Patent [19]

Rhine et al.

[11] Patent Number: 4,579,213

[45] Date of Patent: Apr. 1, 1986

[54] APPARATUS FOR AN AUTOMATED VENDING MACHINE FOR ARBITRARILY PRICED ARTICLES

[75] Inventors: David A. Rhine, Woodland Hills; Robert N. Ross, Burbank, both of Calif.

[73] Assignee: Drewry Photocolor Corporation, Burbank, Calif.

[21] Appl. No.: 725,345

[22] Filed: Apr. 19, 1985

Related U.S. Application Data

[63] Continuation of Ser. No. 431,760, Sep. 30, 1982, abandoned.

[51] Int. Cl.[4] ..... G07F 11/14

[52] U.S. Cl. ..... 194/217; 186/56; 221/155; 235/383; 364/479

[58] Field of Search ..... 186/39, 41, 56, 57, 186/61; 235/381, 383; 364/479, 464; 194/1 M, 1 N, 10, 2; 221/2, 5, 7, 12, 155

[56] References Cited

U.S. PATENT DOCUMENTS

| | | | |
|---|---|---|---|
| 3,491,870 | 1/1970 | Isserstedt | 221/2 X |
| 3,512,679 | 5/1970 | Stoltz | 221/155 X |
| 3,526,308 | 9/1970 | Thomas | 221/5 |
| 3,538,311 | 11/1970 | Weidmann | 235/383 |
| 3,688,087 | 8/1972 | Howard et al. | 235/383 |
| 4,414,467 | 11/1983 | Gould et al. | 235/381 |
| 4,458,802 | 7/1984 | Maciver et al. | 235/381 X |
| 4,519,522 | 5/1985 | McElwee | 364/479 X |

*Primary Examiner*—F. J. Bartuska

*Attorney, Agent, or Firm*—Fulwider, Patton, Rieber, Lee & Utecht

[57] ABSTRACT

Arbitrarily and individually priced articles can be automatically vended from a machine in which the articles are stored without restriction, limitation, or categorization to their individualized prices. The vended articles are compactly stored in a plurality of vertical stacks. Each stack includes a retrieval mechanism which picks the top article from the stack and inserts it into an inclined ladder. The inserted package then moves to the display station where the user determines whether or not the displayed article is to be vended. If the article is to be vended, an appropriate amount of consideration is inserted, counted, and the article is moved to a delivery station within the ladder. If the appropriate amount of consideration has, in fact, been received, the article is dispensed from the delivery station. Otherwise, the article will then be moved to a return station included within the ladder. A return mechanism is positioned at the return station and lays the nonselected package, or empty package carrier in the case a package was selected, in the horizontal position. The return mechanism then places the nonselected package or empty carrier package on the bottom of the storage stack.

9 Claims, 16 Drawing Figures

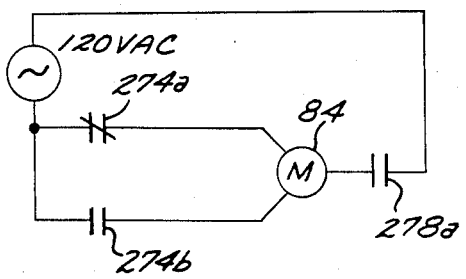
FIG. 13
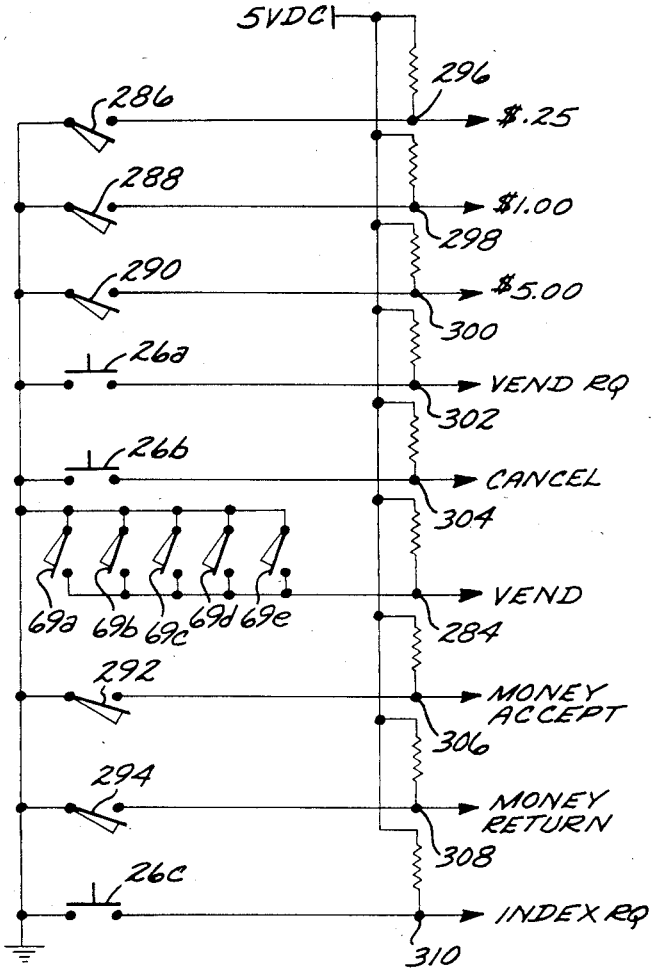
FIG. 15
FIG. 14
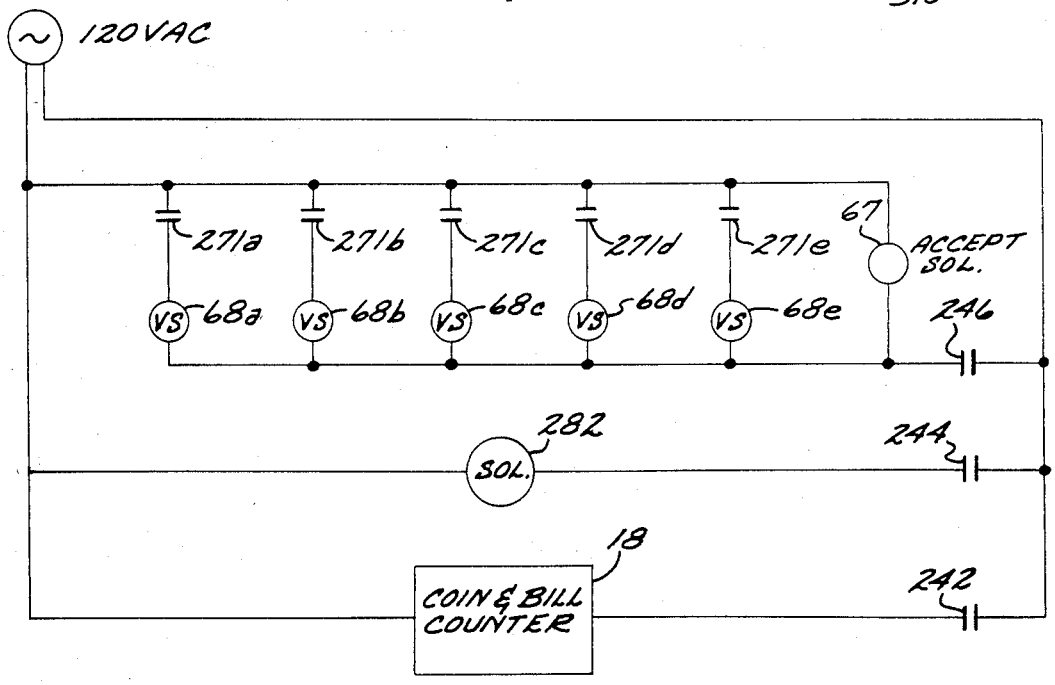

APPARATUS FOR AN AUTOMATED VENDING MACHINE FOR ARBITRARILY PRICED ARTICLES

This is a continuation of application Ser. No. 06/431,760, filed Sept. 30, 1982 now abandoned.

BACKGROUND OF THE INVENTION

1. Field of the Invention

The present invention relates to the field of automatic vending equipment, and particularly to vending equipment which is designed to sell and deliver differently priced articles.

2. The Description of the Prior Art

A substantial industry has arisen relating to the automated vending of articles in individualized transactions. Such vending machines, in addition to dispensing food articles, also dispense small objects of merchandise, stamps, and more broadly include apparatus used as automatic bank tellers for dispensing cash.

One such apparatus is shown by Skillman, "Article Vending System," U.S. Pat. No. 2,663,398, which describes a vending machine which shows a machine used to accumulate the price of a number of differently priced articles before the selected articles are delivered. The vending machine totals up the value of articles selected, gives the user a running total. The vending apparatus releases the selected articles after the user puts in coins which coincide or exceed the machine calculated value of the collection of selected articles. Skillman's apparatus is capable of allowing different calculations for differently selected combinations of fixed-priced articles. However, the apparatus of Skillman does not provide any means capable of reading an arbitrary package price and then dispensing the package to the user after insertion of the appropriate amount of consideration. A set of fixed prices is assumed.

Schuller, et al., "Vendor Control Circuit," U.S. Pat. No. 4,231,105, shows a vending control circuit which uses a microprocessor to maintain the calculated amount of previously selected articles. The value of chosen articles or combination of articles is also displayed for the user's information. However, Schuller is limited by his failure to provide any means which is capable of reading an arbitrary price corresponding to each of the selected articles.

Shigemori, et al., "Automatic Money Dispenser," U.S. Pat. No. 3,914,579, is a cash vending machine controlled by a central processing unit. Shigemori provides a system which is capable of individual transactions and includes a memory register used for storing consideration dispensing data. The user inputs a particular transaction from which he needs a certain amount of cash returned. The central processing unit then identifies the checks necessary for the transaction and dispenses a predetermined amount of consideration to an automatic consideration dispenser. Again, Shigemori is limited by failing to show a system which actually reads an arbitrary package price and then dispenses the package for the appropriate amount of consideration input by the user.

Frubacker, "Computerized Vending Machine," U.S. Pat. No. 4,225,056, also shows a computerized vending system which allows for the dispensation of a plurality of different products. The microcomputer contained within this system compares the price of a selected product with accumulated credit which the user has established. However, Frubacker does not show any means for accommodating articles with individualized and arbitrary prices.

Riddle, "Programmed Multiple Stamp Dispensing Apparatus Employing Optical Electronic Stamp Counting And Auxillary Stamp Roll Capacity," U.S. Pat. No. 3,621,964, is a programmed multiple stamp dispensing system including a counting circuit which generates an output corresponding to the number of stamps requested by the user. Although Riddle's apparatus is capable of operating in a large number of arbitrarily varied transactions, it is still limited by its failure to provide for any individuality of pricing of the articles which are assumed to be priced at the fixed postage rates and stored accordingly. In other words, varied transactions can be executed but only when articles are dispensed according to a categorized storage relating to a fixed number of uniform prices.

What is needed then, is a vending device capable of compactly storing and dispensing articles which have an arbitrary price corresponding to each article in such a manner that the articles need not be prearranged or stored within the dispensing apparatus in any predetermined pattern or arrangement, or be labeled or fixed at any predetermined price or group of prices.

BRIEF SUMMARY OF THE INVENTION

Present invention is a method and apparatus for automatically vending a selected one of a plurality of arbitrarily and individually priced articles. The method of the present invention comprises the steps of compactly storing the articles in a storage area and a plurality of storage subareas. Each storage subarea includes a retrieval mechanism for retrieving one of a multiplicity of articles from a selected one of the storage sub-areas. Firstly, the storage subarea is selected for retrieval of one of the articles stored therein. Next, the stored articles are retrieved from the selected storage subarea by the retrieval mechanism. The retrieved article is then displayed in a display station for visual inspection by the user where the article is oriented for optimal viewing. The user activates a central control circuit to indicate whether or not the displayed article will be chosen. If chosen, a price is read from the displayed article in response to the indication of the user. Price is read by an electromechanical bar code reader which decodes and displays the arbitrary price assigned to the corresponding displayed article. The price can be directly encoded in the bar coding or indirectly through inventory bar code which is used to address a processor controlled read/write mamory. Otherwise, the article is returned to a selected storage subarea by a return mechanism. The return mechanism moves the article to a storage subarea in response to an indication by the user that the displayed article is not to be chosen. If the article is chosen, money or consideration of some type is received from the user in the amount equal to the price read from the displayed article by the bar code reader. The present invention can be used to accept and process credit amounts and prepaid coupons as well as cash. For the purposes of this specification "money" shall be include credit cards, prepaid coupons and other equivalent types of consideration. Consideration received is totalled by a counting mechanism and circuit which determines the amount of consideration offered by the user for the chosen article. The article is then delivered when the consideration offered by the user is at least as much as the price read by the bar code reader. By virtue of these combinations of steps, individually and arbitrarily priced articles may be automatically vended without any arrangement of the articles within the storage subareas relative to their price.

The apparatus of the present invention includes a mechanism for retrieving the articles from the storage area and a mechanism for displaying the articles for selection in an orientation optimized for viewing. The display mechanism is disposed adjacent to the retrieval mechanism and acts cooperately therewith to take the retrieved articles from the storage area from the retrieval mechanism and to move the articles to the display station for viewing. According to user actuation, a bar code reader reads the price from the displayed article. The bar code reader is disposed adjacent to the display station. A delivery mechanism delivers the article to the user in response to an indication from the user that the article is to be chosen. The delivery mechanism is disposed adjacent to the display mechanism and acts in concert therewith to move the article from the display station to a delivery station. By reason of these combination elements, articles may be compactly stored irrespective of their corresponding prices and delivered in response to user selection.

The apparatus of the present invention further includes a receiving mechanism for receiving money or other consideration from the user. The receiving mechanism generates an indication to the delivery mechanism when the consideration received equals at least the amount of the price read from the displayed article. The delivery mechanism then delivers the article contingent upon whether the receiving mechanism indicates that sufficient consideration has been submitted.

The apparatus of the present invention further includes a return mechanism for moving the article from the delivery mechanism to its corresponding storage subarea should the article not be chosen for delivery or not delivered for any other reason.

Finally, the apparatus of the present invention further comprises a central control circuit which coordinates the operation of the retrieval mechanism, display mechanism, bar code reader, receiving mechanism, delivery mechanism, and return mechanism. Communication is also effected through the central control circuit and mechanism to and from the user whereby the complexity and ease of communication between the apparatus and the user can be increased.

These and other embodiments of the present invention can best be understood by reviewing the detailed description of the preferred embodiments in light of the following Figures wherein like elements are referenced by like numerals.

BRIEF DESCRIPTION OF THE DRAWINGS

FIG. 13 is a simplified schematic showing the motor circuit.

FIG. 14 is a simplified schematic showing the solenoid circuit.

FIG. 15 is a simplified schematic showing a circuit which generates output signals used by the processor of FIG. 11.

DETAILED DESCRIPTION OF THE PREFERRED EMBODIMENTS

Figure 1:
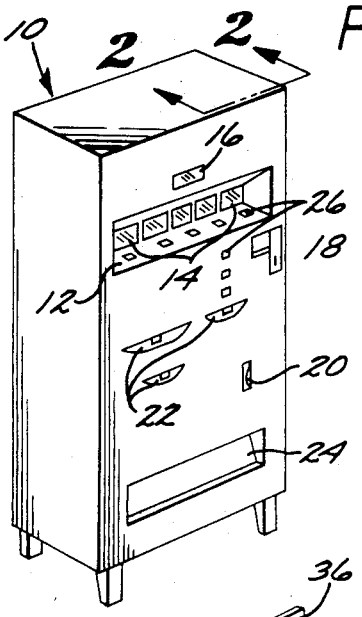
FIG. 1 is a perspective view of a cabinet containing the apparatus of the present invention.

The present invention is an automatic dispensing apparatus and methodology wherein compactly stored articles, each having an arbitrary price, may be retrieved from storage and automatically dispensed without any prearrangement in storage according to price and without restriction to the range or prices associated therewith.

In the illustrated embodiment the articles are processed and unprocessed film packages. Each film processing job is placed within a delivery envelope bearing the customer's name. A bar code is imprinted upon the packaging indicating the cost of the processing job, which cost will generally and arbitrarily vary from job to job. Again, in the illustrated embodiment, the delivery packages are soft envelopes, and are disposed within a package carrier, described below, for compact storage and handling within the automated apparatus. Each carrier, thus, is generally in the form of a rectangle, approximately the size of an ordinary paperback book. The carriers, with their included packages, are then stacked in multiple columns within the vending machine in a "cover-on-cover" stack, in the same manner as books might be stacked on top of each other in a closet. Each stack is contained within a vertical shute which is coupled at its upper and lower extremities to an inclined ladder. The upper portion of the ladder includes a means for taking a carrier from the top of the stack, rotating the carrier until it is parallel to the slope of the inclined ladder, which is in the form of an inclined shute, and inserting the package carrier into the ladder. The carrier is positively driven by a chain or belt mechanism to a display station where the user is able to read the name and address of the customer printed on the package included within the carrier. If not selected, the package continues through a delivery station to a return station where it is again laid flat and inserted into the bottom of the stack by a return means, described in greater detail below. However, if the package is selected, the bar code reader reads the bar code price on the selected package and displays the amount to the customer. The customer then inserts the appropriate amount of consideration or in other embodiments a credit card, or prepaid coupons of equilvalent value.

When the appropriate amount has been inserted, the package can be dispensed, leaving the carrier within the ladder mechanism for ultimate return to the bottom of the storage stack. Communication and operation of the stack and the ladder are coordinated and effected through a microprocessor and supporting circuitry, also described below.

By virtue of this combination of elements just described, packages are compactly stored without prearrangement as to price, drawn from the compact storage, and reoriented in a position for optimum viewing. The packages are then subjected to user selection, and if selected the arbitrary price on the package is read. The process terminates until the user inserts the appropriate amount of consideration. Upon a successful transaction, the package is then delivered, otherwise it is returned to the storage stack and any consideration which may have been inserted, short of the appropriate amount, is returned to the user. This and other embodiments of the present invention and their detailed design and operation are best understood by referring now to FIG. 1.

FIG. 1 illustrates a perspective of the exterior of a cabinet housing the apparatus of the present invention, which cabinet is generally denoted by reference numeral 10. The cabinet 10 includes a recess 12 which has a plurality of viewing windows 14 through which the packages to be dispensed from cabinet 10 can be seen. A multiple line alphanumeric display 16 is provided above viewing windows 14 and provide a means of communication with the customer throughout the transaction. A conventional coin and bill counter 18 is provided for receiving the customer's consideration and includes a coin return 20. Counter 18 could be replaced or supplemented by a credit card reader or fixed value coupon reader. A plurality envelope supply slots 22 are also included in the presently illustrated embodiment of cabinet 10 whereby the customer may reach through slots 22 to grasp between two fingers an exposed edge of an envelope which may later be used for filling out and delivering his next order. In the illustrated embodiment, processed film is vended. Clearly, in the situation where the apparatus of the present invention is used to vend other types of articles, the supply of such items to the customer may be unnecessary. Finally, a delivery shute 24 is provided at the base of cabinet 10 which includes a hopper, better shown in partial sectional view in FIG. 3, into which hopper the processed packages are delivered.

Communication from the customer to the circuitry contained within the present invention is by means of a plurality of push-button switches 26 provided on the front portion of cabinet 10. Thus, when the customer has approached the apparatus incorporating the present invention, he initiates a series of two-way communications with the apparatus by communicating to the apparatus through push-buttons 26 and the apparatus communicating to the customer by alphanumeric display screen 16.

The customer will search through the plurality of packages contained within cabinet 10 until he is able to position his own package behind one of viewing windows 14. At that time, the customer will instruct the apparatus to read the price which will be communicated to the customer on display 16. Money will be inserted in bill and coin counter 18. If the appropriate amount of consideration has been inserted, the apparatus will deliver a package when requested by the customer to delivery shute 24. The customer will remove his delivered package and has the option of also removing an appropriate ordering envelope from slot 22 for his next order.

Figure 2:
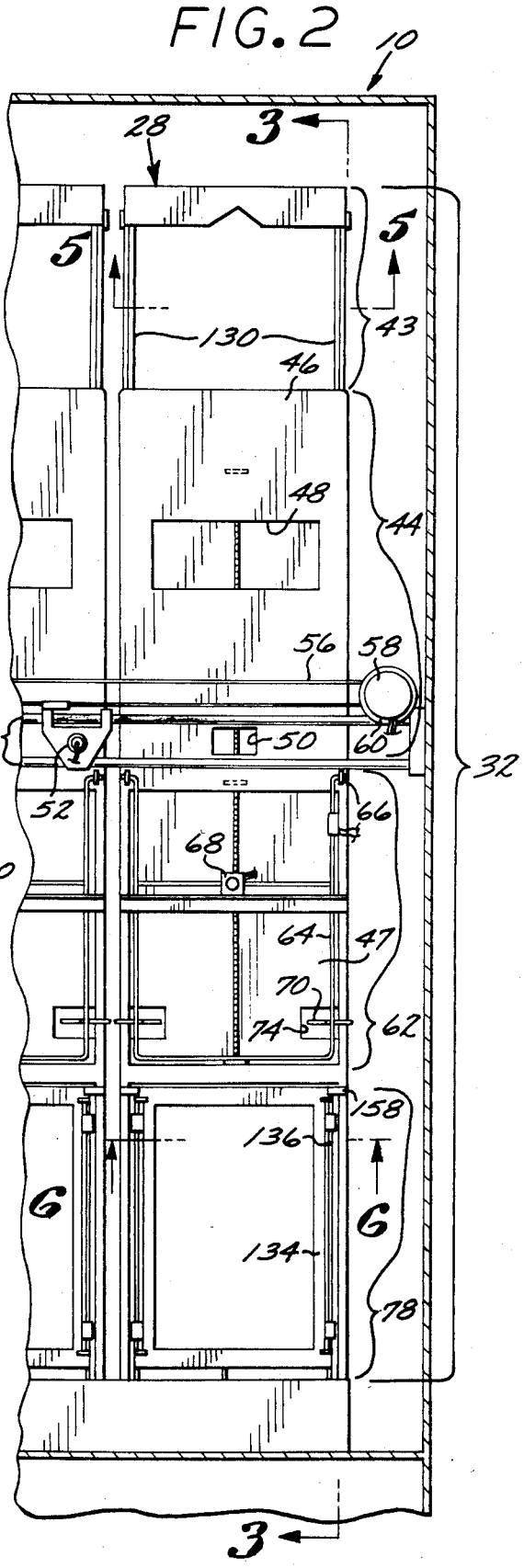
FIG. 2 is a plan view in enlarged scale of one stack mechanism of a plurality of like such mechanism contained within the cabinet of FIG. 1.
Figure 10:
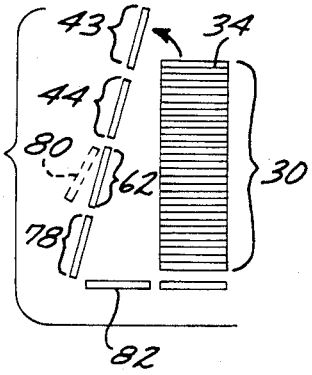
FIG. 10 is a symbolic side view showing the arrangement and motion of packages in the stack mechanism illustrated in FIGS. 2 and 3.
Figure 3:
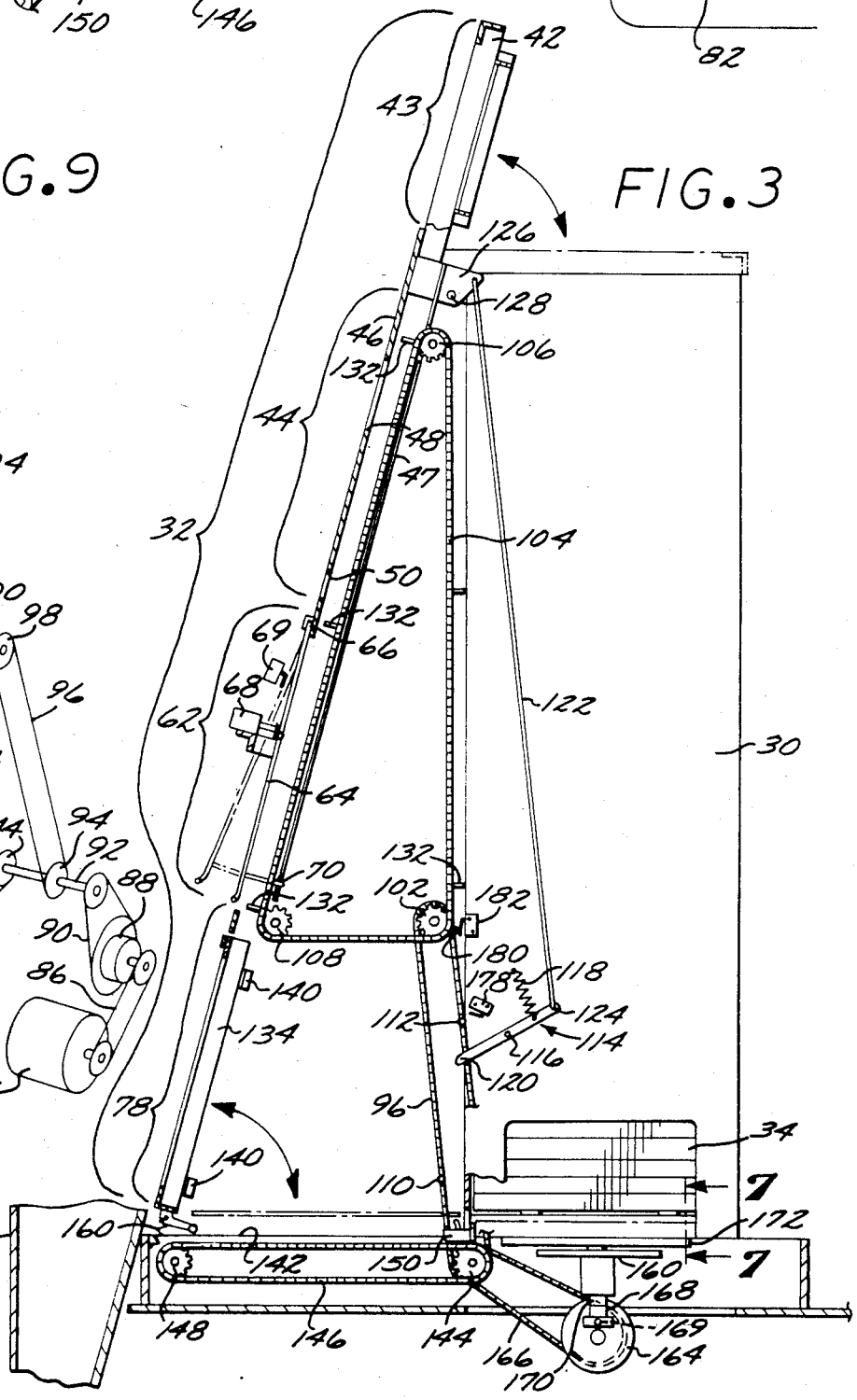
FIG. 3 is a sectional view taken through line 3—3 of FIG. 2.

FIGS. 2 and 3 show in front and side sectional views, respectively, the mechanical apparatus used in the present invention to stack, sort, deliver, and restack the plurality of the packages contained within cabinet 10 according to a cycle symbolically illustrated in FIG. 10.

Turning now to FIGS. 2 and 3, please note that FIG. 2 is a partial front plan view of one of the plurality of circulating stacks, generally denoted by reference numeral 28, included within cabinet 10. In the illustrated embodiment, five such stacks 28 are provided, one behind each of the five viewing windows 14 illustrated in FIG. 1. Clearly, the number of stacks and their dimensions could be increased or decreased according to the desired application. FIG. 3 is a sectional side view taken through line 3—3 of FIG. 2 and more clearly illustrates the storage area 30 of stack 28 and its corresponding inclined ladder 32, which is shown in plan view in FIG. 2. Storage stack 30 shown in FIG. 3 is a vertical bin for containing and guiding a plurality of package carriers 34 which are horizontally stacked in storage stack 30.

Figure 8:
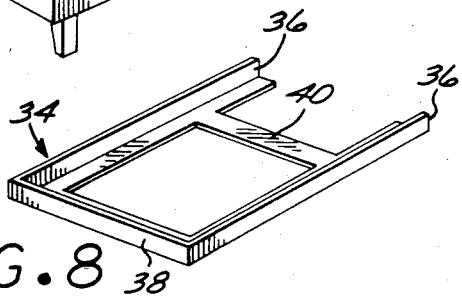
FIG. 8 is a perspective view in enlarged scale of a package carrier of the present invention.

Package carrier 34 is better illustrated in FIG. 8 and is shown as an open-sided rectangular frame, including two parallel sides 36 joined by a bottom horizontal end 38 and an opposing across member 40 formed near the opposing ends of sides 36. A package (not shown) is laid in package carrier 34 with the open face of package carrier 34, shown as the top surface of carrier 34 as illustrated in FIG. 8, facing the front surface of ladder 32 and cabinet 10. In the illustrated embodiment, the open-faced structure of package carrier 34 allows a soft package of variable size to be uniformly handled by stack 28 and to be easily removed therefrom by means described below.

Referring to FIG. 10, the cycle the circulating stack 28 is summarized and diagramatically illustrated. Package carriers 34 are illustrated in the absence of the depiction of stack 28 to show the cycling of carriers 34 through stack 28. Vertical stack and package carriers 34 are included within storage stack 30 and are maintained in position by the rectangular chute which defines the enclosure of storage stack 30. A package carrier 34 is moved from the bottom of storage stack 30 upwardly with stacked package carriers 34, ultimately to the top of storage stack 30. It is then picked off the top of storage stack 30 by loading arm 42 and oriented within ladder 32 at loading station 43. Package carrier 34 is then moved to viewing station 44 where it is displayed and read if desired. The package then moves to delivery station 62 where it will be delivered if selected as suggested by a dotted outline of the package 80. If unselected, the package continues to return station 78 where it is laid flatly as shown by package carrier 82 from whence it is moved horizontally across the base of stack 28 to the bottom of the plurality of stacked carriers 34 in storage area 30.

The general cycle having been described and shown in FIG. 10 will now be generally described in connection with FIGS. 2 and 3.

Referring again to FIG. 3, package carriers 34, compactly stacked in storage stack 30, are moved upwardly within storage stack 30, again by means described in greater detail below, to the top of stack 38 where each package carrier 34 and its included packaged article is picked up by a loading arm 42 and oriented in an inclined position for insertion within ladder 32 as shown by the position of loading arm 42 in FIG. 3. Ladder 32 is essentially defined by a face plate 46 and an opposing back wall 47 which cooperate to form a channel equal to the thickness of carrier 34 plus a small amount of clearance. Although ladder 32 has been shown as defined by face plate 46 and back wall 47, side channels for slidingly engaging the sides of package carries 34 with the side channels connected by structural cross members may be employed in lieu of face plate 46 and back wall 47. A non member will be enlarged in the area of window 50 for aesthetic display of the vended article similar to face plate 46 as shown in FIG. 2. Package carrier 34 is then moved down ladder 32, sliding between plate 46 and wall 47, to a viewing station 44 where a viewing window 48 has been defined in plate 46. For the purposes of clarity, no packages have been shown loaded within ladder 32 of FIG. 2. Plate 46 of viewing station 44 also includes the price window 50 defined in the lower portion of plate 46. Thus, when a package within a package carrier 34 is disposed in viewing station 44, the name, address, or other identifying information on the package included within package carrier 34 may be read through window 48 while a conventional bar code, imprinted on the package, is exposed through window 50. However, in the other embodiments package labeling or the article itself will be displayed through window 50 to allow the user to identify the type of article in the display station.

Normally, only window 48 can be seen through viewing windows 14 of cabinet 10. A conventional bar code reader 52, better shown in FIG. 2, is movably disposed on a pair of rails 54 for disposition across window 50 of plate 46. Bar code reader 52 is driven by a servomechanism connected to drive wheel 58 which drives belt 56. Belt 56 in turn moves bar code reader 52 on rails 54. Drive wheel 58 is connected to and driven by a stepping motor 60 controlled by the circuitry of the present invention described in greater detail in connection with FIGS. 11–16.

Returning again to FIG. 3, packages are then moved from viewing station 44 to a delivery station 62. Delivery station 62 includes a solenoid actuated delivery gate 64, hinged at its upper extremity on pivot points 66 and actuated by a solenoid 68. If the package is to be delivered, solenoid 68 is actuated, thereby pulling gate 64 from the position shown in FIG. 3 in solid outline to that shown in dotted outline. Gate 68 includes a finger 70 which reaches behind back wall 47 and through cut outs 74 provided in back wall 47 of ladder 32 as best seen in FIG. 2. Fingers 70, provided on each side of gate 64, thus push the lower edge of the package contained within package carrier 34 out of package carrier 34. The package then falls down the face of ladder 32 into a delivery hopper 76 included within cabinet 10 as best seen in FIG. 3 in fragmentary sectional view.

However, if the package is not delivered, the package carrier 34 is moved to a return arm 78 which rotates downwardly to re-orient package carrier 34 in a horizontal direction as shown in dotted outline in FIG. 3. Package carrier 34 is then moved rearwardly across a return base 77 of stack 28 and is placed on the bottom of the stack of package carriers 34 in storage stack 30.

Figure 9:
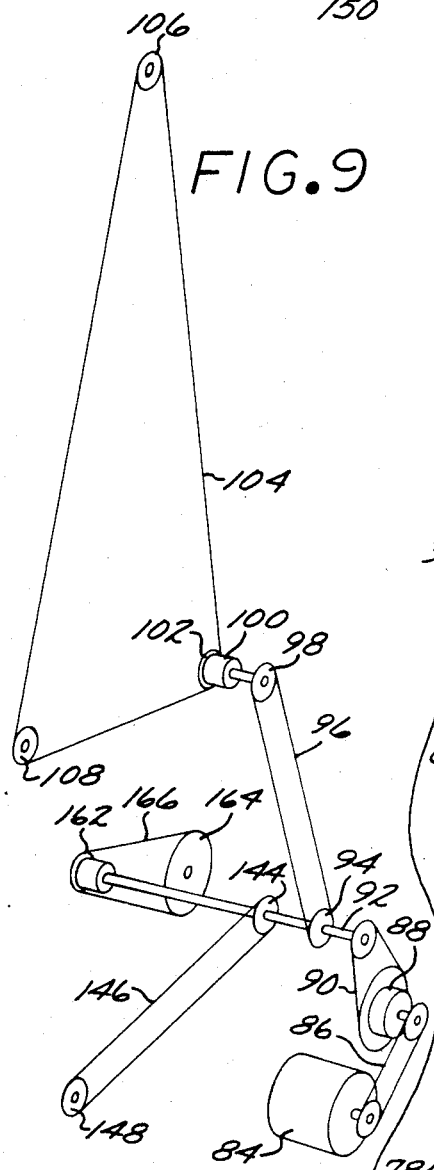
FIG. 9 is a diagramatic view of the motive system of the stack illustrated in FIGS. 2 and 3.

Refer now to FIG. 9, which diagramatically shows the linkage used in the present invention to effect the operations described above. A motor 84 is coupled by a chain or belt 86 to a selectively activated electric clutch 88. A single motor 84 is used for all of the five stacks 28 included within cabinet 10. Each stack includes an electric clutch 88 which is coupled by means of a chain or belt to a main drive shaft (not shown) which in turn is driven by motor 84. The main drive shaft is omitted from FIG. 9 and a direct chain or belt linkage 86 is shown between motor 84 and electric clutch 88 in FIG. 9 for the sake of simplicity. However, cabinet 10 will normally include five electric clutches, like clutch 88 of which only one is actuated at any time.

Electric clutch 88 in turn is coupled by means of chain or belt 90 to a stack drive shaft 92 through conventional gearing. Drive shaft 92 has a first drive gear 94 coupled by means of chain or belt 96 to a driven gear 98. Gear 98 is connected to a one-way clutch 100. Therefore, even if chain or belt 96 is reversed directed, one-way clutch 100 transmits only one sense of rotation through conventional gearing 102 to a conveyor chain or belt 104. Chain 104 is then led upwardly to the top of stack 28 behind back wall 47 to an idler gear 106 and thence down the face of ladder 32 in front of back wall 47 to a second idler gear 108 and back to clutch gear 102.

Referring now to FIG. 3, chain or belt 96 is shown in side view leading up from the base of stack 28. Drive gear 94 and shaft 92 are not visible in the view of FIG. 3. Chain 96 mounts two fingers 110 and 112 for engagement with one end 20 of a rocker arm 114. Rocker arm 114 is rotatable about a central pivot 116 and is spring biased in a counterclockwise direction by tension spring 118. As chain or belt 96 rotates in a clockwise direction, finger 112 will contact end 120 of arm 114, thereby causing arm 114 to rotate in a counterclockwise direction as viewed in FIG. 3. A rigid push rod 122 is rotatably coupled on one end to end 124 of arm 114 opposite the end 120 and is rotatably coupled on its opposite end to a bell crank 126 carried from one end of the loading arm 42. The loading arms of bracket 126 are rotatably carried from stack 28 by means of 128. Therefore, as push rod 122 moves upwardly, loading arm 42 is moved in a counterclockwise direction to the solid line position shown in FIG. 3. Spring 119 ensures that loading arm 42 is fully rotated in the counterclockwise direction against plate 46 which limits its counterclockwise rotation. When thus fully rotated, loading arm 42 will be appropriately aligned with ladder 32 allowing package carrier 34 to slip from loading arm 42 into ladder 32 between face plate 46 and back wall 47.

When chain or belt 96 is rotated in a counterclockwise direction, projection 110 will eventually be brought into contact with end 120 of arm 114, thereby causing arm 114 to rotate in a clockwise direction against the bias of spring 118. Push rod 122 will then be pulled downwardly causing bracket 124 to also rotate in a clockwise direction. Loading arm 42 will then be lowered to a position wherein it is substantially horizontal and picks off the top package carrier from the stack of storage stack 30.

Figure 5:
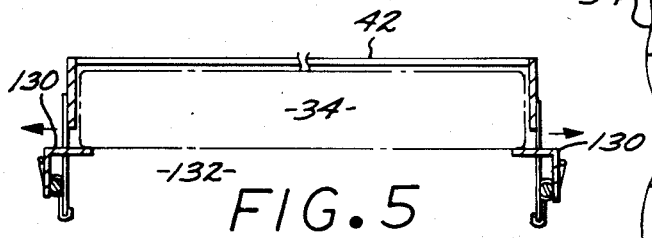
FIG. 5 is a sectional view in enlarged scale taken through line 5—5 of FIG. 2.

Refer now to FIG. 5 taken through line 5—5 of FIG. 2. Loading arm 42 includes a spring-loaded latching bar 130 on each side of its forward face. As loading arm 42 is lowered onto the top of the stack, a package carrier 34 shown in dotted outline in FIG. 5 moves into the front face 132 of loading arm 42 past latching bars 130. The back surface of package carrier 34 moves latching bars 130 outwardly as shown by the arrows in FIG. 5 which bars act like a spring-loaded swinging door while package carrier 34 continues to move into loading arm 42. When package carrier 34 is entirely disposed in loading arm 42, that is when loading arm 42 lies horizontally with respect to the top of storage area 30 as shown in FIG. 3, the front edge of carrier 34 will have passed latching bars 130. Latching bars 130 will then snap back into the positions shown in FIG. 5. Loading arm 42 can then be rotated in a counterclockwise direction as shown in FIG. 3, thereby lifting carrier 34 from the top of the stack, which carrier will be retained within loading arm 42 by engagement along its front edges by latching bars 130, also shown in plan view in FIG. 2.

Once carrier 34 is aligned in the position shown in FIG. 3, sufficient clearance exists within loading arm 42 such that carrier 34 will drop downwardly until the bottom edge 38 of carrier 34 contacts projection 132 on chain or belt 104. Chain 104 is provided with five such projection which serve as a means for engaging and positively carrying package carrier 34 through ladder 32.

Figure 6:
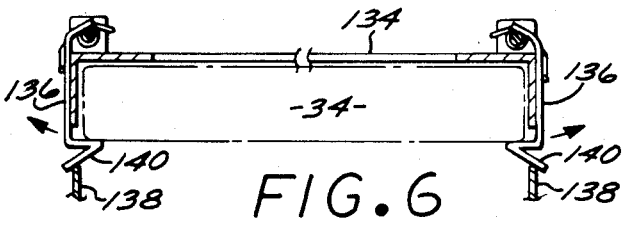
FIG. 6 is a fragmentary sectional view in enlarged scale taken through line 6—6 of FIG. 2.

Package carrier 34 will thus be moved or pushed through ladder 32 between back wall 47 and face plate 46 by means of projection 132 on chain or belt 104 driven by one-way clutch 100 illustrated in FIG. 9. If unselected, carrier 34 will ultimately move from delivery station 62 to return station 78 where it is pushed by projection 132 into return arm 134. Referring now to FIG. 6 taken through line 6—6 of FIG. 2, return arm 134 is shown as having two spring-loaded retaining bars 136 on each edge of arm 134. Package carrier 34 is thus captively retained within arm 134 by retaining bars 136. As return arm 134 rotates in a clockwise direction as shown in FIG. 3, it lays package carrier 34 down in horizontal orientation. Retaining bars 136 will engage vertical projections shown in fragmentary sectional view in FIG. 6. Projections 138, which form part of base of stack 28, contact an extended inclined tab 140 of retaining bars 136. As retaining arm 134 continues to move downwardly, the contact between projection 138 and inclined tab 140 causes retaining bar 136 to rotate outwardly as shown by the direction of the arrows in FIG. 6, thereby releasing package carrier 34. Carrier 34 then falls to a return station, horizontal bed 142, shown in FIG. 3.

Referring now to FIG. 9, drive shaft 92 is also connected thereto a drive gear 144 which engages chain or belt 146. Chain 146 drives an idler gear 148 and provides the motive force for moving a package carrier 34 across bed 142 to the bottom of storage stack 30. Gears 144 and 148 are shown in side view in FIG. 3.

Figure 4:
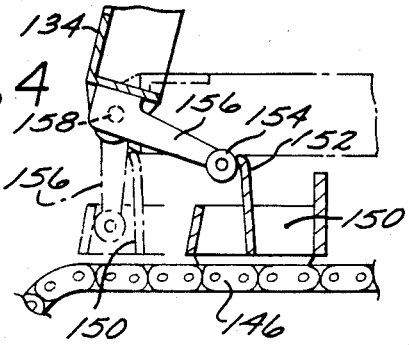
FIG. 4 is a fragmentary sectional view of one portion of the return arm of the present invention as best shown in the lower left corner of FIG. 3.

FIG. 4 illustrates the detailed structure of an actuating clip 150 fixed to chain or belt 146. Clip 150, shown in the right-hand-most portion of FIG. 3 and in the left-hand-most portion in FIG. 4, is used to positively engage and push package carrier 34 to the bottom of storage stack 30 as well as to actuate return arm 134. Clip 150 has a vertical finger 152 which engages a roller 154 provided at the end of lever arm 156. Lever arm 156 is pivoted about pivot 158 and rigidly connected at its opposing end to return arm 134. As shown in FIG. 4, as clip 150 moves to the left, finger 152 engages roller 154 causing return arm 134 to rotate about pivot 158 until it lies in a horizontal position depicted in dotted outline in FIG. 4. At that position, lever arm 156 will be oriented in the generally vertical direction also shown in dotted outline in FIG. 4. A tension spring 160 schematically shown in FIG. 3, will rotate return arm 134 to an upright position in alignment with ladder 32. The opposing end of return arm 134 is aligned when rotated with ladder 32 by being brought into contact with stop-tap 158 shown in side view in FIG. 3 and more clearly shown in plan view in FIG. 2.

Before package carrier 32 is moved fully to the right to the bottom of storage stack 30, all package carriers within the stack are forced upwardly within storage stack 30 by means of an eccentrically driven elevator 160, shown in side view FIG. 3. Turning now to FIG. 9, drive shaft 92 is also coupled to a one-way clutch 162, which in turn is coupled to a large driven wheel 164 by means of chain or belt 166. Referring now to FIG. 3, driven wheel 164 has a roller 168 eccentrically mounted off-center on a radius of wheel 164. Roller 168 operates in a horizontal track 169 in the bottom of piston 170. Thus, piston 170 will be driven upwards and then downwards on each rotation of wheel 164, thereby lifting and later lowering platform 172. Package carriers 134 are pushed to the right in FIG. 3 by clip 150 onto platform 172.

Figure 7:
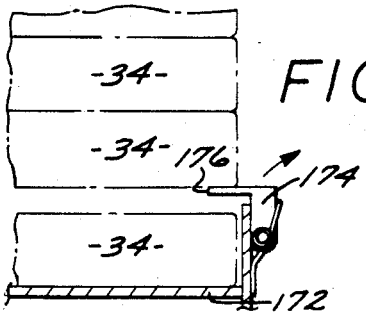
FIG. 7 is a fragmentary sectional view taken through line 7—7 of FIG. 3.

When platform 172 lifts upwardly, it forces four catch bars 174 open as shown in FIG. 7. One such catch bar 174 is provided at each corner of storage stack 30. The upper surface of package carrier 34 contacts edge 176 of catch bar 174 causing catch bar 174 to rotate in clockwise direction as shown by the arrow in FIG. 7. Once package carrier 34 has been lifted by platform 172 a sufficient height, leg edge 176 will move past the lower surface of the lifted package carrier 34. Catch bar 174, which is spring-loaded, will then snap back into place between platform 172 and the lower surface of carrier 34, thereby holding the entire stack of carriers 34 in storage stack 30 in the elevated position. Platform 172 is then lowered as eccentric roller 168 draws down piston 170 in preparation for the disposition of the next package carrier 34 by clip 150 on the bottom of storage stack 30.

Now that the mechanical linkage and operation has been described in connection with FIGS. 2–10, it is possible to understand the synchronization and timing of the various elements. The cycle is initiated by activating motor 84 and the appropriate electric clutch 88 (FIG. 9) corresponding to the selected storage stack 30 (FIG. 3). Drive shaft 92 begins to rotate in a counterclockwise direction thereby causing chain or belt 96 to generally rotate in the counterclockwise direction, and thereby bringing projection 110 in contact with end 120 of lever arm 114. Lever arm 114 rotates in a counterclockwise direction pulling down push rod 122 thereby lowering loading arm 42. However, gear 102 remains stationary since one-way clutch 100 (FIG. 9) is slipping without driving gear 102. After package carrier 34 has been picked up by loading arm 42, lever arm 114 will have contacted microswitch 178. As will be described below in greater detail in connection with FIG. 12, closing microswitch 178 causes motor 84 to be reversed, thereby driving chain or belt 96 in the reverse direction. Eventually, projection 112 will contact end 120 of lever arm 114 thereby rotating lever arm 114 in a counterclockwise direction, driving push rod 122 upwardly and causing loading arm 42 to rotate in a counterclockwise direction. In the meantime, clutch 100 drives gear 102 to position projection 132 on chain or belt 104 just below loading arm 42 as illustrated in FIG. 3. When loading arm 42 achieves the upright position, package carrier 34 is then aligned with ladder 32 between face plate 46 and back wall 47. Carrier 34 is dropped into ladder 32 until it contacts projection 132.

However, while loading arm 42 was rotating downwardly to pick up the next package carrier, drive shaft 92 was also driving gear 144 (FIG. 9) in a counterclockwise direction, thereby causing clip 150 to move to the left in FIG. 3 in actuate return arm 134 in the manner described in connection with FIG. 4. Thus, when loading arm 42 is horizontal, return arm 134 is also horizontal and has placed a package carrier on horizontal base 142. When motor 84 reverses, clip 150 then moves to the right, thereby pushing the package carrier, which was just dropped, to the bottom of storage stack 30. However, while clip 150 was moving to the left thereby ultimately causing return arm 134 to drop a package on base 142, drive shaft 92 was rotating wheel 164 through one-way clutch 162. This caused cam 168 to actuate platform 172 and the entire stack of package carriers was being lifted within storage stack 30. Therefore, the upper package carrier 34 was lifted into loading arm 42 in addition to loading arm 42 being lowered onto storage stack 30. Platform 172 is then lowered. However, when motor 84 reverses direction, one-way clutch 162 will not drive wheel 164 and platform 172 remains in a fixed lowered position while clip 150 moves to the right in FIG. 3 pushing package carrier 34 into the bottom of storage stack 30.

While motor 84 is being reversed, chain or belt 96 is rotating about gear 102 in a generally clockwise direction until a projection 180 on chain or belt 96 contacts a microswitch 182. When switch 182 is contacted, this marks the end of the reverse cycle and the motor direction is stopped. Power is supplied through switch 182 and contact 270 in FIG. 12 motor run relay 272 until switch 182 is opened at the end of the cycle. Activating the index push button 26 starts the cycle anew. As motor 84 reverses and assumes its original sense of rotation, clip 150 will be moved to the left in FIG. 3, arm 114 will rotate in a clockwise direction actuating loading arm 42 to pick up the next package carrier, and chain or belt 104 will be rotated in a generally counterclockwise direction moving one package carrier into the delivery station 62 and another package carrier, which was just picked up by loading arm 42 in the previous cycle, into display station 44. Similarly, chain or belt 104 will also be delivering the last package carrier placed in delivery station 62 to return station 78.

Figure 11:
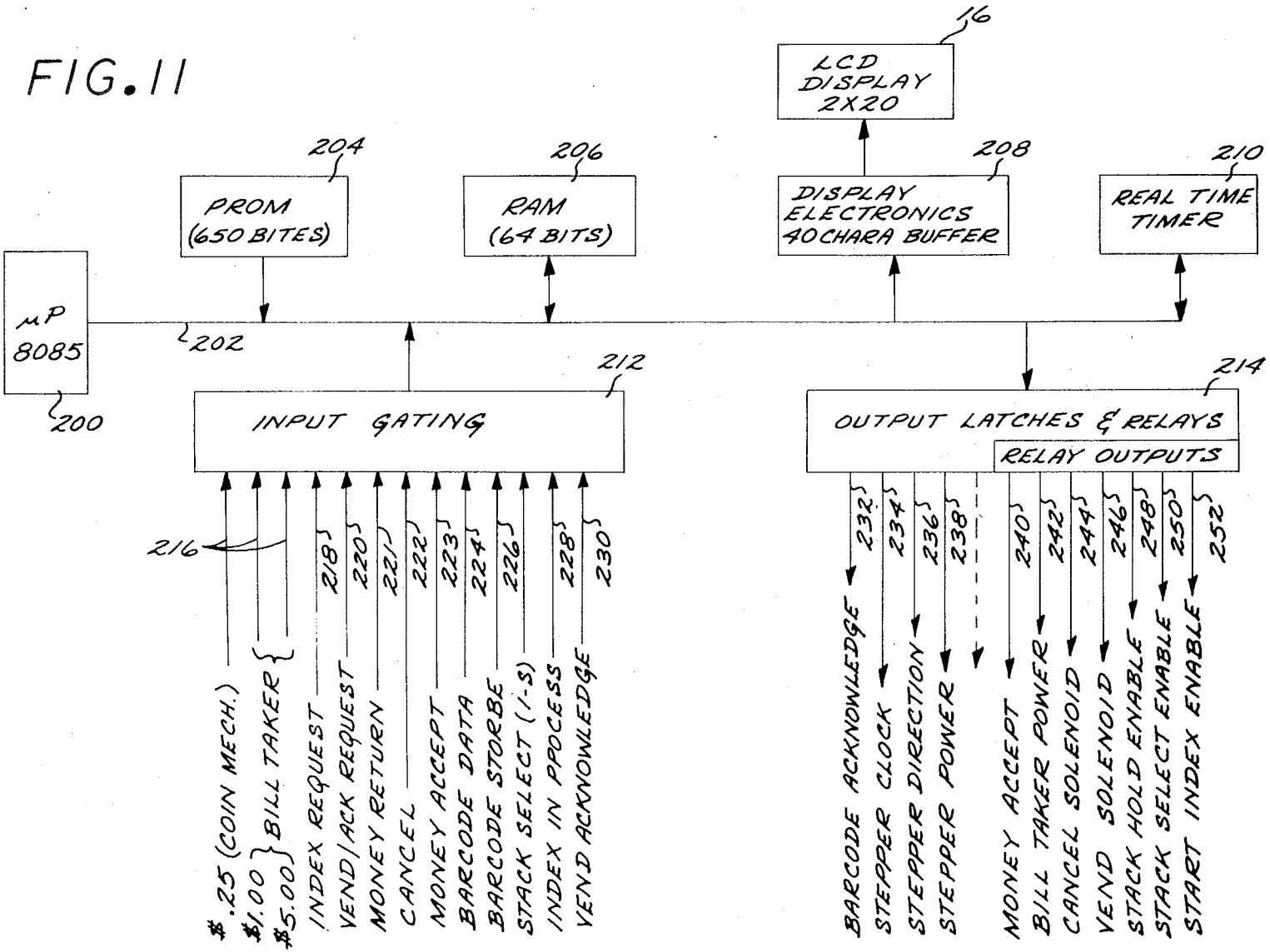
FIG. 11 is a block schematic of the processor system used to control the apparatus of FIGS. 1–10.

Turning now to FIG. 11, the circuit organization of the present invention is illustrated in a block schematic. A conventional central processing means or microprocessor 200, an Intel 8085 manufactured by Intel Corp. of Santa Clara, Calif., is coupled to bi-directional data and address/control bus 202 around which the remaining elements of the circuit are organized. For example, programable read only memory (PROM) 204 is coupled to bus 202 as well as to random access memory (RAM) 206. A conventional software program is stored with PROM 204 which has a memory capacity of the order of 650 bytes while RAM 206 is used as a scratch memory for utilization during program execution, which has a capacity of approximately 74 bytes. Conventional software programming techniques are used to execute and order the operation of the apparatus as described above in connection with FIGS. 1–10 and FIG. 16. By and large, microprocessor 200 is dedicated to communicating with the customer through display electronics buffer 208 coupled to bus 202 and LCD display 16 first described in connection with FIG. 1. Display electronics buffer 208 is a conventional 40 character buffer which translates data from bus 208 to a format compatible for driving LCD display 16. For example, as is well known to the art, buffer 208 includes a character ROM used as a look-up table to translate data from microprocessor 200 to LCD display 16. LCD display 16 is a Model AND1861 LCD module manufactured by AND of Burlingame, Calif. and has a five by seven dot matrix display arranged in an array of two lines of 20 characters each.

Real time timer 210 is also coupled to bus 202 and provides an exterior, hardware circuit used for timing long intervals by providing an interrupt signal to processor 200. As described above and in FIG. 16, if the customer is required to make a decision at some point during the transaction and he fails to make the decision within a predetermined time period, such as within 30 to 60 seconds, real time timer 210 will return an interrupt timeout signal on bus 202 at the end of the predetermined time period. This allows a more convenient and efficient method for providing long, timed intervals than by the use of a software controlled counter within processor 200.

Microprocessor 200 is also coupled through bus 202 to a conventional input gating circuit 212. Data, which is the object of manipulation by processor 200, is received through input gating circuit 212, processed and then appropriately coupled to output latch and relay circuit 214 through bus 202.

Consider first the inputs to input gating circuit 212. A plurality of inputs, three shown as a matter of example in FIG. 11, are taken from conventional coin and bill counter 18 described in FIG. 1. The bill and coin data inputs 216 the consideration signals, are shown only to include signals signifying the receipt of 25 cents, one dollar and five dollars. However, it must be expressly understood that the number of coin and bill inputs 216 are entirely arbitrary and three are only illustrated for the purposes of example. Additional bill and coin inputs could be provided to cover all denominations of coin possible if desired, thereby allowing the consideration offered by the customer to equal the price of the product even to the nearest cent. Similarly, data inputs 216 could be provided by a credit card reader or fixed value coupon reader which would also allow the input of an arbitrary price.

The customer initiates the transaction by pushing one of the selection means or push button switches 26 directly below window 14 as shown in FIG. 1 to generate a selection signal which selects a stack. As described in greater detail in connection with FIG. 12, the selection signal activates a relay which in turn energizes electric clutch 88 (FIGS. 9 and 12) thereby enabling one of the five stacks 28. The customer then pushes another switch 26 to generate a second selection signal; the INDEX REQUEST signal on input 218 thereby causing the selected stack to advance the stored packages through the sorting, viewing and delivery cycles.

Input 220 receives a VEND/ACKNOWLEDGE REQUEST signal to cause a selected package to be delivered by solenoid operated gate 64 as described in connection with FIG. 2.

Input 222 receives a CANCEL signal also generated by selective actuation of a cancel switch 26 to allow the customer to cancel the transaction at any time to thereby reinitialize the state of the apparatus and to return any monies inserted.

Input 224 is a price or code signal, a seven bit input which receives the bar code reader data from conventional bar code reader 52 described in connection with FIG. 2. Input 226 receives a bar code strobe signal which is part of the handshake with bar code reader 52 and its associated conventional circuitry (not shown) to indicate to processor 200 that bar code reader 52 has obtained valid data and is ready to transmit.

Input 226 receives a STACK SELECT selection signal which was generated by the customer's actuation of an appropriate one of the stack switches 26 below windows 14 which indicates to processor 200 which of the five stacks were chosen. Processor 200 then directs bar code reader 52 to read the price exposed in the appropriate stack window 50 shown in FIG. 2 when and if a VEND/ACKNOWLEDGE REQUEST is received.

Figure 12:
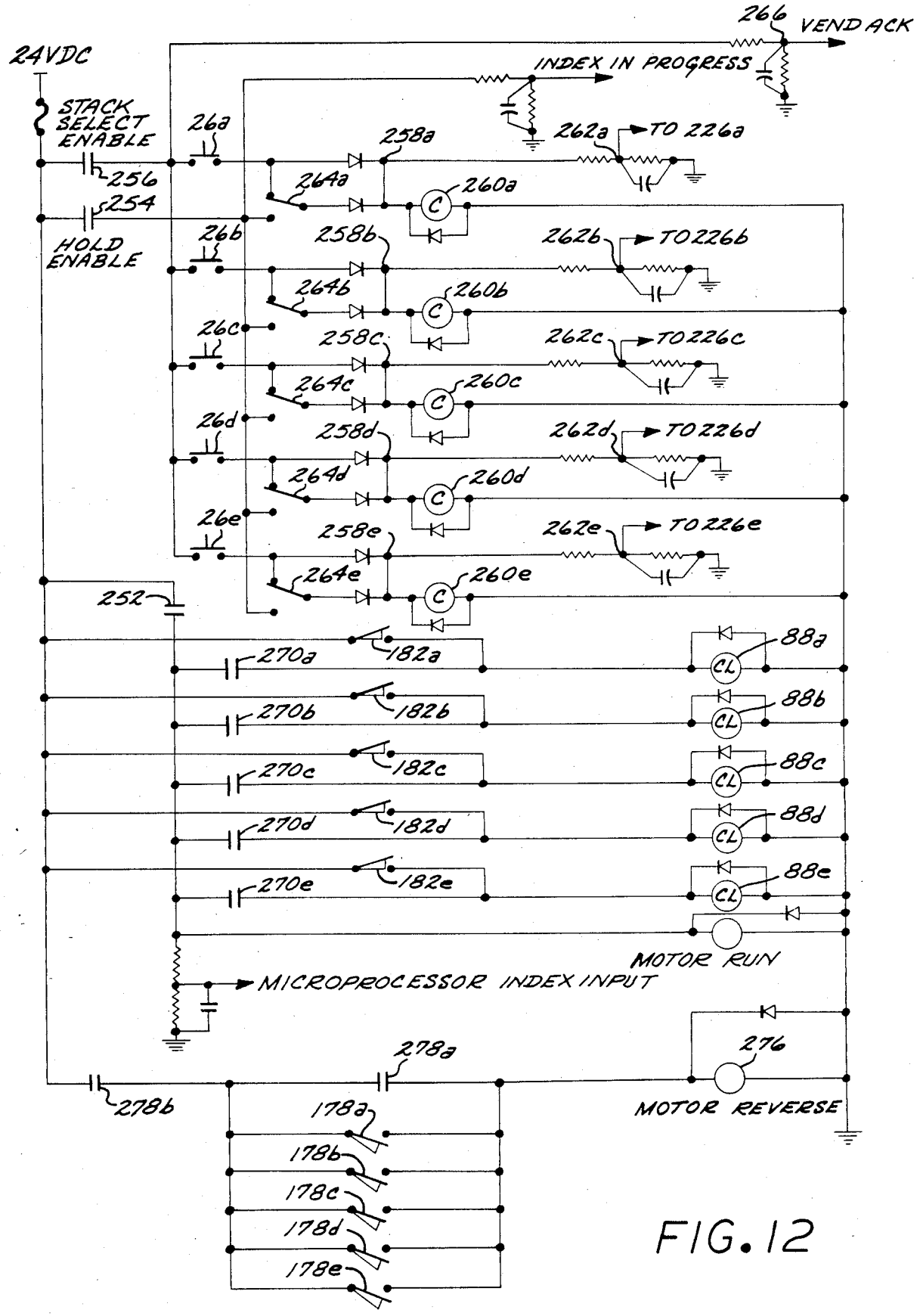
FIG. 12 is a simplified schematic of a relay network used to control the apparatus of FIGS. 1–10.

Input 228 receives an INDEX IN PROCESS signal generated from the circuitry of FIG. 12 which advices processor 200 that the apparatus described in FIGS. 1–10 is in the process of indexing or moving a package through the stack cycle summarized in connection with FIG. 10 and that no other operation can be executed until the index cycle has been completed.

Finally, input 230 receives a VEND ACKNOWLEDGE signal from switch 69 in FIG. 3 which indicates to processor 200 that package has been appropriately vended.

Output latches and relays 214 include as outputs the BAR CODE ACKNOWLEDGE signal on output 232 which serves as the other portion of the bar code reader handshake in combination with BAR CODE STROBE on input 226. The BAR ACKNOWLEDGE signal on output 232 is TTL compatible and provides an indication to bar code reader 52 that the bar code data sent by bar code reader 52 has been received and accepted by processor 200, thereby releasing bar code reader 52 for the next task. Bar code reader 52, as previously stated, is driven by a stepper motor 60, the STEPPER CLOCK is provided at output 234, the direction of rotation through a STEPPER DIRECTION signal on output 236 and STEPPER POWER on output 238. Power to stepper motor 60 is applied only during operation of bar code reader 52 so that when the apparatus is in the idle state, overheating and damage to motor 60 is prevented.

Output 240, MONEY ACCEPT, is consideration signal generated by processor 200 to coin and bill counter 18 to indicate to counter 18 that the appropriate amount of consideration has been inserted and that the consideration should be deposited in a receiving bin (not shown) included as part of a conventional consideration taker. Power is provided to coin and bill counter 18 through output 248, BILL TAKER POWER, which is also supplied only during the operation of the apparatus in order to avoid undue power consumption or damage to counter 18. A CANCEL SOLENOID signal provided in output 244 is coupled to coin and bill counter 18 to power a solenoid included within that counter to cause the monies received to be returned to the customer. The CANCEL SOLENOID signal is activated whenever the customer has cancelled the transaction by causing input 222 to go active or has failed to index or vend an article within a predetermined time as clocked by real time timer 210.

Output 246 provides a VEND SOLENOID signal used to power delivery solenoid 68 discussed in connection with FIG. 2. The VEND SOLENOID signal from output 248 is coupled to the appropriate vend solenoid 68 in one of the five stacks 28 through the use of STACK SELECT ENABLE and STACK HOLD ENABLE signals provided on the outputs 248 and 250. Finally, output 252 provides a START INDEX CYCLE signal which is used to activate motor 84 thereby initiating the indexing cycle as described above. Once the indexing cycle has been initiated, microswitches 178 and 182 will electromechanically control the reversal and termination of the indexing cycle. Each of the outputs 240–252 are actually relay contacts which are active when closed. The corresponding relays are activated by circuit 214 in response to processor 200. Thus, they are interchangably referenced herein as signals or as contacts.

The use and exploitation of these various input and output signals can now be described in connection with FIGS. 12–16. Turning now to FIG. 12, a schematic of the circuitry relating to electric clutches **88*a*–88*e* of the five stacks 28*a*–28*e* is shown. Throughout the following description whenever an element described generally in FIGS. 1–10 is referenced in FIGS. 11–16, a letter suffix will be appended to denote the different stacks to which it corresponds. Thus, solenoid 68 of FIG. 3 would have corresponding solenoids 68*a*–68*e* referenced in FIGS. 11–15. The letter suffix in the reference numeral is to be understood as appropriately relating that circuit element to stacks 28*a*–28*e***.

When the customer initates operation of the apparatus, he pushes a button which puts a VEND/ACKNOWLEDGE REQUEST signal on input 218. Through conventional software programming, processor 218 detects a VEND ACKNOWLEDGE REQUEST and since the apparatus is in the idle state, START INDEX CYCLE singal at output 252, STACK SELECT ENABLE on output 250, and STACK HOLD ENABLE on output 248 each go active by closing a relay contact as part of output latch and relay circuit 214. FIG. 12 schematically shows contact 254 as the HOLD AND ENABLE contact and relay contact 256 as the STACK SELECT ENABLE. When contacts 254 and 256 close, it is then possible to activate push-button switches **26*a*–26*e*, which are the stack select switches 26 described in connection with FIG. 1 positioned below and corresponding to each of the five display windows 14**.

Assume that the customer pushes switch **26*a*. Power is then coupled through contact 256, switch 26*a* to node 258*a* to relay coil 260*a*, thereby energizing relay coil 260*a*. Node 258*a* is also coupled to a passive filter circuit 262*a*, the output of which is one of the five stack select input signals coupled to input 226 of input gating circuit 212 of FIG. 11. Once coil 260*a* has been energized, contact 264*a* closes, thereby completing a circuit path through contact 254 to coil 260*a*. The customer may then release pushbutton switch 26*a* and coil 260*a* remains energized. Thereafter, STACT SELECT ENABLE contact 256 goes inactive and opens. Until later permitted by processor 200, activation of switch 26*a* will not change the status of the circuit, and no other stacks can be enabled by activation of their corresponding push-button switches 26*b*–26*e*. At the end of operation, HOLD ENABLE contact 254 opens pursuant to software control from processor 200 thereby deenergizing relay coil 260*a* and returning the circuitry to the powerdown status. Each of the relays 260*b*–260*e* have identical associated filters and contacts and operate with respect to their corresponding stacks 28*b*–*e*** and the identical manner. Therefore, throughout this discussion, the circuitry corresponding to only one stack shall be described, and it can be assumed that the circuitry corresponding to each of the other stacks is identical both in design and in operation.

The output of HOLD ENABLE contact 254 is coupled to a passive filter circuit 256 whose output in turn is the then VEND/ACKNOWLEDGE signal coupled to input 230 of input gating circuit 212 in FIG. 11. Thus, when any one of the five relays 260*a*–260*e* have been activated and held in an active condition, VEND/ACKNOWLEDGE is provided from filter circuit 256 to processor 200. Similarly, the output of contact to 256 is coupled to a passive filter circuit 268 whose output is the INDEX IN PROGRESS signal coupled to input 228 of input gating circuit 212. Whenever any one of the five push button switches 26*a*–26*e* has been pushed, the INDEX IN PROGRESS signal at the output of filter 268 will go active, thereby preventing processor 200 from subsequently reading any of the other STACK SELECT signals on the input of 226 provided as the outputs 226*a*–226*e* of filters 262*a*–262*e*. Therefore, the first push button switch 26*a*–26*e* which is activated will be the selected column and all other selections will be ignored by processor 200.

Referring now again to FIG. 3, in the initial position, projection 180 will be in contact with microswitch 182 causing microswitch 182, which is normally closed, to open. Referring to FIG. 12, microswitch 182*a* is shown in the initial position as open. When START INDEX CYCLE contact 252 closes and relay coil 260*a* is energized as described above, contact 270*a* will close as well. Power will then be provided through contact 252 and 270*a* to electric clutch 88*a*. In addition, power is supplied through contact 252 to forward motor relay 272. Motor 84, schematically shown in FIG. 13, has power supplied to it through contact 274 controlled by reverse relay 276 described below, which is normally closed. Since forward motor relay 272 is energized, contact 278*a* is closed. A circuit is completed through closed contact 274, motor 84, and contact 278*a* of relay 272. However, after the motor begins to run in a forward direction, projection 180 releases microswitch 182 as described in connection with FIG. 3, and limit switch 182*a* in FIG. 12 will return to its normally closed position. Thus, power will continue to be supplied to clutch 88*a* even when after one second of operation, solenoid 260*a* is deenergized by the opening of HOLD ENABLE contact 254 through software control, and thus even though contact 270*a* is opened.

However, since forward relay 272 is energized, its corresponding contact 280*a* will be closed. Referring now to FIG. 3, lever arm 114 has been rotated in a counterclockwise direction and as seen in FIG. 3 closes microswitch 178, microswitch 178*a* in FIG. 12 will close thereby energizing reverse motor relay 276. When reverse motor relay 276 is energized, contact 280*a* closes thereby completing a circuit through contacts 278*b* and 280*a* to reverse relay 278.

Referring to FIG. 13, when reverse relay 276 is energized, contact 274*a* opens and contact 274*b* closes thereby applying a reverse polarity to motor 84 and reversing its direction. As chain or belt 96 of FIG. 3 reverses direction, projection 112 will contact lever arm 114 causing it to rotate in a counterclockwise direction, thereby releasing switch 178 which returns to its normally open position as shown in FIG. 12. Motor 84 continues to run in reverse until projection 180 once again contacts microswitch 182*a* thereby opening the microswitch and deenergizing clutch 88*a*. Stack 28 will thus then remain in its initial position with motor 84 running and relays 272 and 276 energized. START NEXT CYCLE contact 252 will then be opened according to processor control thereby deenergizing forward relay 272, opening contact 278*b* and deenergizing reverse relay 276. Similarly, as shown in FIG. 13, when forward motor relay 272 is deenergized, contact 278*a* will open as well thereby shutting motor 84 off.

FIG. 14 is the schematic showing the delivery solenoid circuitry. Delivery solenoid 68 in FIG. 3 is relfected in FIG. 14 as solenoids 68*a*–68*e*. Power to each solenoid 68*a*–68*e* is coupled through a contact 271*a*–271*e* on relays 260*a*–260*e* respectively in FIG. 12. However, the selected solenoid will not be activated unless then vend solenoid contact 246 is closed pursuant to processor control. Similarly, a cancel solenoid 282 included within coin and bill counter 18 is similarly energized in circuitry of FIG. 14 by closure of CANCEL SOLENOID contacts 244. Activation of cancel solenoid 282 causes coin and bill counter 18 to return any monies inserted. Finally, the power to coin and bill counter 18 is similarly provided through BILL TAKER POWER contact 242, which again is processor controlled as described in connection with the circuitry of FIG. 11.

Referring to FIG. 3, delivery gate 64, operated by solenoid 68 is associated with a microswitch 69 which is shown in the schematic of FIG. 15 as microswitches 69*a*–69*e*. These microswitches are normally open and will be closed when corresponding solenoid 68*a*–68*e* is energized. When anyone of these switches 69*a*–69*e* is closed, the output at node 284 goes active low, providing the input signal VEND ACKNOWLEDGE to input 230 of input gating circuit 212 described in connection with FIG. 11. Similarly, coin and bill counter 18 includes microwswitches 286–294 which are physically actuated by the operation of counter 18. For example, microswitch 286, 288 and 290 are activated whenever a quarter, dollar, or five dollar bill, respectively, are inserted. Thus nodes 296–300 will provide the $0.25, $1.00, and $5.00 input signals to inputs 216 of input gating circuit 212. Push button switches 26, when closed will similarly cause the VEND REQUEST signal at node 302 to go low which is then coupeld to input 220 of input gating circuit 212. Closure of push button switch 26*b* generates an active low signal at node 304 corresponding to the CANCEL signal coupled to input 222 of input gating circuit 212. Similarly, closure of microswitches 292 and 294 in counter 18 generates a signal at nodes 306 and 308 respectively, indicating that counter 18 has accepted the offered money, MONEY OK. Counter 18 includes conventional rejection circuitry to discriminate between genuine and counterfeit consideratio which is coupled to input 223 of circuit 212. A low active signal on node 308 signifies the completion of a MONEY RETURN from counter 18 which is also communicated to circuit 212 through input 221. Finally, the activation of push button switch 26*c* causes an active low signal at node 310 interpreted as the INDEX REQUEST signal coupled to input 218 of input gating circuit 212.

Figure 16:
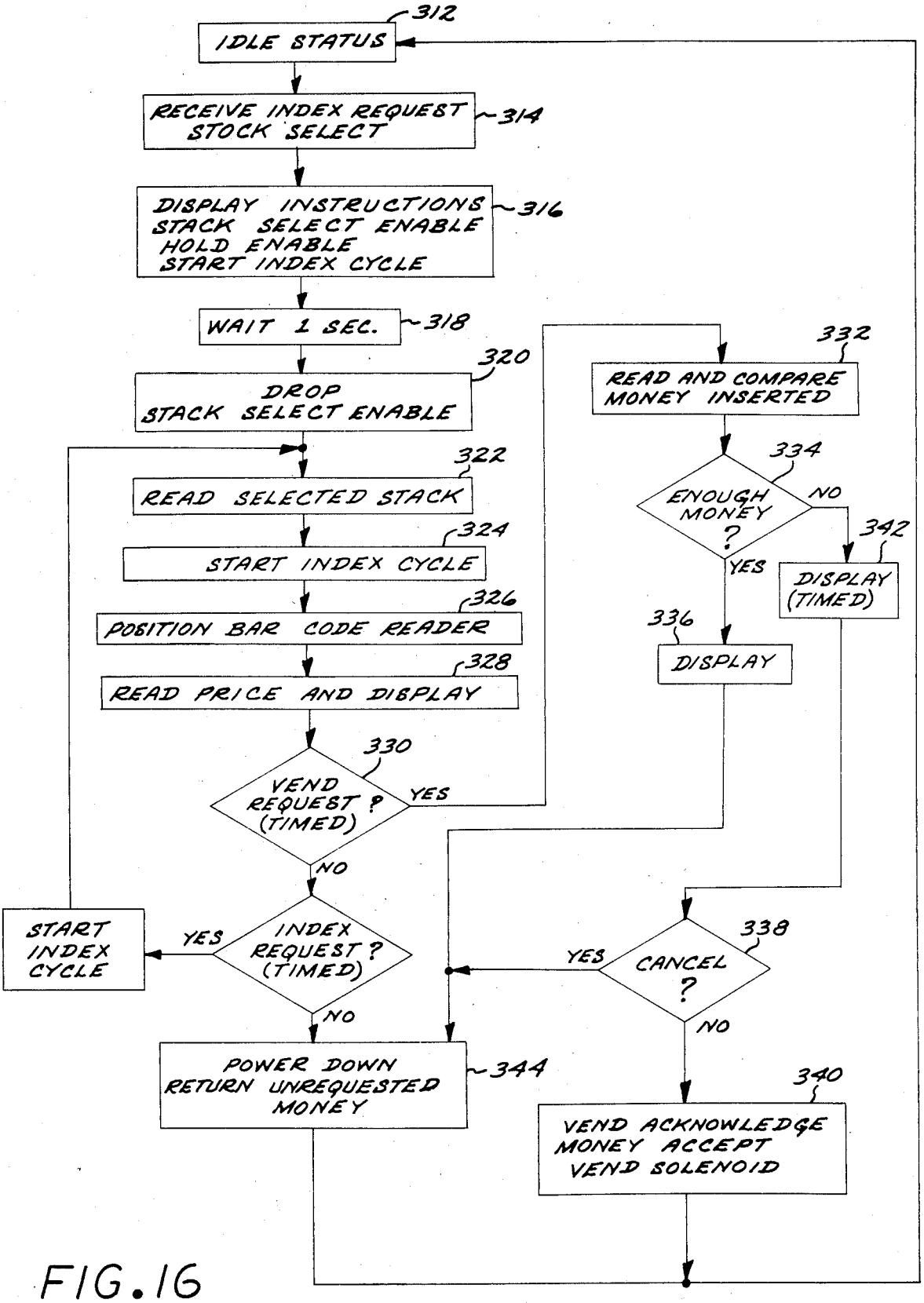
FIG. 16 is a flow diagram illustrating the methodology executed by the processor of FIG. 11.

FIG. 16 shows a simplified flow diagram illustrating the process executed by processor 200. Processor 200 is normally running in an idle status at step 312. INDEX REQUEST input 218 and STACK SELECT input 226 are periodically sampled at step 314 to determine whether or not a customer has generated a selection signal, having entered an INDEX REQUEST or STACK SELECT when pushing one of the push button switches 26 on cabinet 10 shown in FIG. 1. As soon as a customer has activated one of switches 26, processor 200 displays appropriate instructions through display electronics 208 to LCD display 16 at step 316 and activates STACK SELECT ENABLE relay contacts 256 and HOLD ENABLE RELAY contact 254. In addition, START INDEX CYCLE contact 252 has also been closed by processor 200, the corresponding relays 260*a*–260*e* have been energized and corresponding clutches 80*a*–88*e* engaged with motor 84 running in the forward direction. After a one second delay executed at step 318, HOLD ENABLE and STACK SELECT ENABLE contacts 254 and 256 are opened at step 320 to prevent any interference by the customer with the indexing cycle being executed in the selected stack 28. After stack 28 has completed the indexing cycle, as electromechanically controlled as described in connection with FIG. 12, the select stack signals 262*a*–262*e* will be read at inputs 226 of circuit 212 in step 322. After sufficient time has passed for execution of the index cycle, START INDEX CYCLE contacts 252 will be opened at step 324 to reinitialize the apparatus for the next indexing step if requested.

Bar code reader 52 is appropriately positioned over the selected stack at step 326 as controlled by the processor output signals on outputs 234–238 of output latches and relay circuit 214 of FIG. 11 if a VEND REQUEST is made. Processor 200 always returns bar code reader 52 to a home position and calculates the direction and number of pulses which must be transmitted to stepping motor 60 in order to appropriately pass bar code reader 52 across the bar code exposed through window 50 of the selected stack 28. The price is read from the package bar coding at step 328. According to processor control, bar code reader will be repeatedly drawn over window 50 up to a limit of six times until the price is read, otherwise the process is terminated and an error code indicated to the customer, directing the customer to contact a specified location to obtain assistance.

The price is then displayed on LCD display 16 and a processor 200 waits for a predetermined time for a VEND REQUEST. Real time timer 210 is used to give the customer a predetermined amount of time to read the price and insert the required consideration into coin and bill counter 18. If a VEND REQUEST is received within the appropriate time at step 330, the consideration received is then compared against the price read at step 332. If enough consideration has been inserted as determined at step 334, an appropriate instruction is then displayed at 336 inquiring whether or not the customer desires at that time to cancel the transaction as determined at step 338. If not, the customer actuates VEND ACKNOWLEDGE signal at input 230 and MONEY ACCEPT and VEND SOLENOID signals are generated at outputs 240 and 246 respectively with result that the package is vended and the inserted consideration is dropped into a collection bin at step 340. Processor 200 may then ask the customer whether an additional transaction is requested or may return to the idle status at step 312.

However, if at step 334, insufficient amount of consideration has not been inserted, a customer is advised of this fact through a display at step 342 which is timed. If a sufficient amount is not inserted within a predetermiined amount of time, the appartus is powered down and the accepted consideration is returned at step 344 in the same manner as if the customer had cancelled the transaction at step 338. During the power-down sequence at step 344, processor 200 turns off all large power consumers within the apparatus such as motor 84, stepping motor 60, coin and bill counter 18, and all other solenoids and relays. Processor 200 then returns to the idle status at step 312 and cycling is reinitialized.

It must be understood that many other alterations and modifications may be made by those having ordinary skill in the art without departing from the spirit and scope of the present invention. Although a specific circuitry and mechanism controlled by the circuitry has been illustrated, equivalent mechanisms could be optionally substituted for nearly every described element without substantially varying from the inventive concept. Control is shared between processor 200 and the logic as shown in the circuitry of FIGS. 11–15. More of the control could be included within discrete logic of the type illustrated in FIGS. 11–15 or more could be included within the methodology of processor 200 as summarized in FIG. 16 according to design choice.

For example, although the illustrated embodiment has been shown as including a cycling routine and mechanism which will allows the user to sort through a compactly stacked vertical column of articles in view of the articles as they descend a ladder, it is clearly within the scope and intent of the present invention that other sorting schemes could be used as well, or that the packages themselves need not be sorted. For example, package carriers 34 could be vertically stacked and include and additional bar code identifying the user by name, address, phone number, and job description. A bar code reader could then vertically traverse each stack reading the identifying information while displaying such information to the user through LCD display 16. If an article were to be selected, the bar code reader or second bar code reader could then be directed to read the price from the selected article. When the consideration had been appropriately inserted, an article grasping and pulling mechanism would then be actuated to grasp and horizontally pull the article from the stack, followed by releasing delivery of the article through a delivery shute. The stack order can be fixed in the sense that each article would be stored on a fixed shelf, or the stack could simply collapse shortly in height if permitted by packaging design as each article was removed. Clearly, such alternative mechanisms do not depart from the intent of the present invention wherein articles are compactly stored, individually priced, individually read, and individually dispensed without prearrangement or categorization as to their nature or price.

The illustrated embodiment has been as described as including a coin and bill acceptance mechanism 18. However, it is clearly within the scope of the present invention that mechanism 18 could be supplemental by a credit card reader including such additional interface circuitry as would be needed to communicate to a remote central computer. Similarly, a prepaid coupon reader would include circuitry for reading and decoding the coupon. In the case where the apparatus communicates with a central computer, a keyboard could be included for two-way communication between the user and central computer through the alphanumeric display or a voice synthesizer.

The illustrated embodiment has been described only for the purposes of illustration and clarity and should not be taken as limiting or defining the scope of the present invention which is set forth in the following claims.

We claim:

1. A vending machine for automatically vending articles bearing coded prices to a customer and comprising:

a housing including a storage bin, an article display window for displaying an article, and a delivery chute;

reader means, disposed adjacent said display window, for automatically reading the coded price of an article positioned in said display window, said reader means being responsive to the coded price to generate a corresponding electrical price signal;

retrieval means for automatically retrieving the article from said storage bin, delivering the articles to said display window, and returning an article from said display window to said storage bin;

price display means for displaying a discernable numeric price, corresponding to the coded price on an article, in said display window;

selector means responsive to activation by a customer to generate a location signal corresponding to the article in said display window;

consideration receiving and counting means for automatically receiving and counting consideration from the customer, said receiving and counting means being responsive to the amount of consideration counted to generate a corresponding electrical consideration signal;

central processing means electrically coupled between said reader means, said receiving and counting means, and said selector and including memory means and program means for receiving and comparing said consideration signal to said price signal and operative in response to said consideration signal equalling or exceeding said price signal to generate a delivery control output signal;

delivery means, including ejection means, electrically coupled to said central processing means and operative in response to said delivery control output signal for ejecting a selected article from said display window to said delivery chute, whereby said retrieval means may carry articles sequentially from said storage bin to said display window for viewing by a customer who may, upon viewing a desired article in said display window, activate said selector means and deposit sufficient consideration to cause said consideration signal to equal or exceed said price signal to cause said central processing means to generate said delivery control outut signal to thereby actuate said delivery means to eject such desired article from said display window to said delivery chute.

2. The vending machine of claim 1 wherein:

said housing is formed with a storage bin configured to receive a plurality of stacks of said articles, and includes a display window for each stack;

said retrieval means further includes means for retrieving articles from each stack and conveying them along respective predetermined paths for delivery to the respective display windows and for returning the article to the respective stacks;

said ejection means includes means for ejecting a selected article from each of said display windows for delivery to said delivery chute;

said selector means further includes selector switches on said housing in electrical connection with said central processing means, one switch associated with each of said display windows, and operative to generate respective location signals;

said central processing means further includes means generating position control signals responsive to said location signals, and wherein said vending machine further includes:

rails mounted from said housing and spanning said predetermined paths;

a carriage mounting said reader means on said rails for travel therealong to selected locations adjacent the coded price on the article being displayed in the respective display windows; and position control means, electrically connected with said central processing means, and responsive to said position control signals to shift said carriage along said rails to dispose said reader means at said selected locations.

3. The vending machine of claim 1 wherein:

said housing includes a price display means;

said central processing means includes means responsive to the coded price read by said reader means to generate a price display output signal; and said machine includes means responsive to said price display output signal to display a price image on said screen corresponding with said coded price.

4. The vending machine of claim 2 wherein:

said retrieval means further includes a face plate to support the articles as they are retrieved and conveyed along said pre-determined paths and an elongated gate having first and second ends, pivotally mounted on said first end from said face plate for pivoting said gate from a retracted position to an eject position, said gate including pusher fingers on said second end of said gate for supporting the article when said gate is in said retracted position; and said ejection means further includes a solenoid having a moveable inner core within a coil, said core mounted to said gate, said solenoid electrically coupled to said central processing means and operative in response to said delivery control output signal to draw said gate into said eject position.

5. The vending machine of claim 1 wherein:

said storage bin is configured to receive a vertical stack of said articles;

said retrieval means includes conveyor means for receiving said articles and conveying them past said display window to a return station, a loader means for sequentially transferring said articles from the top of the stack to said conveyor means and a return means for receiving unselected articles from said conveyor means and returning them to the bottom of said storage stack.

6. The vending machine of claim 4 wherein:

said loader means includes a loader arm pivotally connected on one end to said housing and including on its opposite end latching means operative in response to said loader arm being rotated to a horizontal position and engagement with an article on top of said storage stack to latch onto said article, said arm and latching means being operative upon said arm being raised to a vertical position to deliver said article to said conveyor means;

said retrieval means including linkage means connected with said loader arm for repeatedly rotating said loader arm between said horizontal and vertical positions.

7. The vending machine of claim 6 wherein:

said delivery chute is disposed below said delivery station;

said delivery means includes a delivery gate pivotally carried on one end from said housing and including on its opposite end at least one ejector finger operative upon rotation of said gate from a first to a second position to engage an article on said conveyor at said delivery station to eject said article from said conveyor to said chute and actuating means coupled between said gate and said housing responsive to said delivery control output signal to pivot said gate from said first to said second position.

8. The vending machine of claim 5 wherein:

said return means includes a return arm pivotally connected on its bottom extremity to said housing and pivoted from a vertical receiving position to a horizontal release position;

said return means further including at the free extremity of said return arm resilient retainers cooperating with said arm to receive unselected articles from said conveyor means and release means mounted on said housing in the path of said retainers as said return arm pivots from said receiving portion to said release portion and operative upon engagement by said retainers to release said articles from said return arm for return to the bottom of the stack.

9. The vending machine of claim 8 wherein:

said return means includes reciprocating elevating means mounted from said housing under said storage stack, operable to repeatedly raise said stack upwardly a pre-determined distance, said returns means further including at least one catch pivotally mounted on one end from said housing and including on its opposite ends a leg shiftable from a holding position in the path of said articles as they are raised upwardly by said elevating means to a return position retracted from said path, bias means biasing said latch to said holding portion and a pusher for pushing unselected articles from said return arm to the underside of said stack.

* * * * *

UNITED STATES PATENT AND TRADEMARK OFFICE

CERTIFICATE OF CORRECTION

PATENT NO. : 4,579,213

DATED : April 1, 1986

INVENTOR(S) : Rhine, David A. et al

It is certified that error appears in the above-identified patent and that said Letters Patent is hereby corrected as shown below:

Column 3, line 60, start new paragraph with FIG. 3;

Column 6, line 37, after "cycle" insert --of--;

Column 9, line 68, delete "stop-tap" and insert --stop-tab--;

Column 13, line 42, after "is" insert --the--;

column 14, line 30, delete "singal" and insert --signal--;

Column 16, line 33, delete "microwswitches" and insert --microswitches--;

Column 17, line 64, delete "iined" and insert --ined--; and

Column 19, line 48, delete "outut" and insert --output--.

Signed and Sealed this

Second Day of December, 1986

*Attest:*

DONALD J. QUIGG

*Attesting Officer*

*Commissioner of Patents and Trademarks*